US008073356B2

(12) United States Patent
Nakashima

(10) Patent No.: US 8,073,356 B2
(45) Date of Patent: Dec. 6, 2011

(54) IMAGE FORMING APPARATUS HAVING AIR FLOW HOLES

(75) Inventor: Atsuhisa Nakashima, Obu (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 305 days.

(21) Appl. No.: 12/412,396

(22) Filed: Mar. 27, 2009

(65) Prior Publication Data

US 2009/0245849 A1 Oct. 1, 2009

(30) Foreign Application Priority Data

Mar. 27, 2008 (JP) ..... 2008-083986

(51) Int. Cl.
*G03G 21/00* (2006.01)
*G03G 21/20* (2006.01)

(52) U.S. Cl. ..... 399/92

(58) Field of Classification Search ..... 399/92, 399/94, 107
See application file for complete search history.

(56) References Cited

U.S. PATENT DOCUMENTS 6,141,512 A * 10/2000 Nagano et al. ..... 399/92
6,226,474 B1 * 5/2001 Kowalski et al. ..... 399/92
6,885,836 B2 * 4/2005 Kimura et al. ..... 399/92 X
6,975,814 B2 * 12/2005 Tsusaka et al. ..... 399/107 X
2007/0071484 A1 * 3/2007 Igarashi ..... 399/92

FOREIGN PATENT DOCUMENTS

| | | | |
|---|---|---|---|
| JP | 63-185148 | | 11/1988 |
| JP | 04-307568 | | 10/1992 |
| JP | 11-341202 | | 12/1999 |
| JP | 2005-037704 | A * | 2/2005 |
| JP | 2006-072030 | A | 3/2006 |
| JP | 2006-079015 | A | 3/2006 |
| JP | 2007-086629 | | 4/2007 |
| JP | 2007-086629 | A | 4/2007 |
| JP | 2007-196574 | | 8/2007 |
| JP | 2008-018673 | | 1/2008 |

OTHER PUBLICATIONS

Office Action for counterpart JP Application No. 2008-083986 mailed Nov. 10, 2009.

* cited by examiner

*Primary Examiner* — Sophia S Chen
(74) *Attorney, Agent, or Firm* — Banner & Witcoff, Ltd.

(57) ABSTRACT

An image forming apparatus with a plate having holes is described. An image forming apparatus includes image carriers, side walls, and a plate disposed below the image carriers. The plate includes a plurality of holes along the sides of the plate near the side walls. The image carriers, the side walls, and the plate form one or more passages for air to flow during operation of a cooling fan.

9 Claims, 3 Drawing Sheets

IMAGE FORMING APPARATUS HAVING AIR FLOW HOLES

CROSS REFERENCE TO RELATED APPLICATION

This application claims priority from Japanese Patent Application No. 2008-083986, filed on Mar. 27, 2008, the entire subject matter of which is incorporated herein by reference.

FIELD

Aspects of the invention relate to an image forming apparatus configured to electrophotographically form an image on a recording medium. More specifically, aspects of the invention relate to an image forming apparatus including a sheet supply unit that is configured to hold recording media in stack, and a plurality of image formation units that are arranged in line along an upper surface of the sheet supply unit.

BACKGROUND

A known image forming apparatus may include some units that produce heat, such as an image formation unit having an image carrier, e.g. a photosensitive drum, and a scanner unit that is configured to expose the photosensitive drum to light. To prevent overheating in such units of the image forming apparatus, a variety of cooling methods by channeling air inside the apparatus have been proposed. For example, such a structure has been proposed that includes a passage that is configured to channel air between the image formation unit and the scanner unit, a duct that is configured to convey air to a lower part of the image formation unit, and a fan that is configured to produce air.

SUMMARY

Aspects of the invention provide an image forming apparatus configured to effectively discharge air inside.

BRIEF DESCRIPTION OF THE DRAWINGS

Illustrative aspects will be described in detail with reference to the following figures in which like elements are labeled with like numbers and in which.

DETAILED DESCRIPTION

Figure 1:
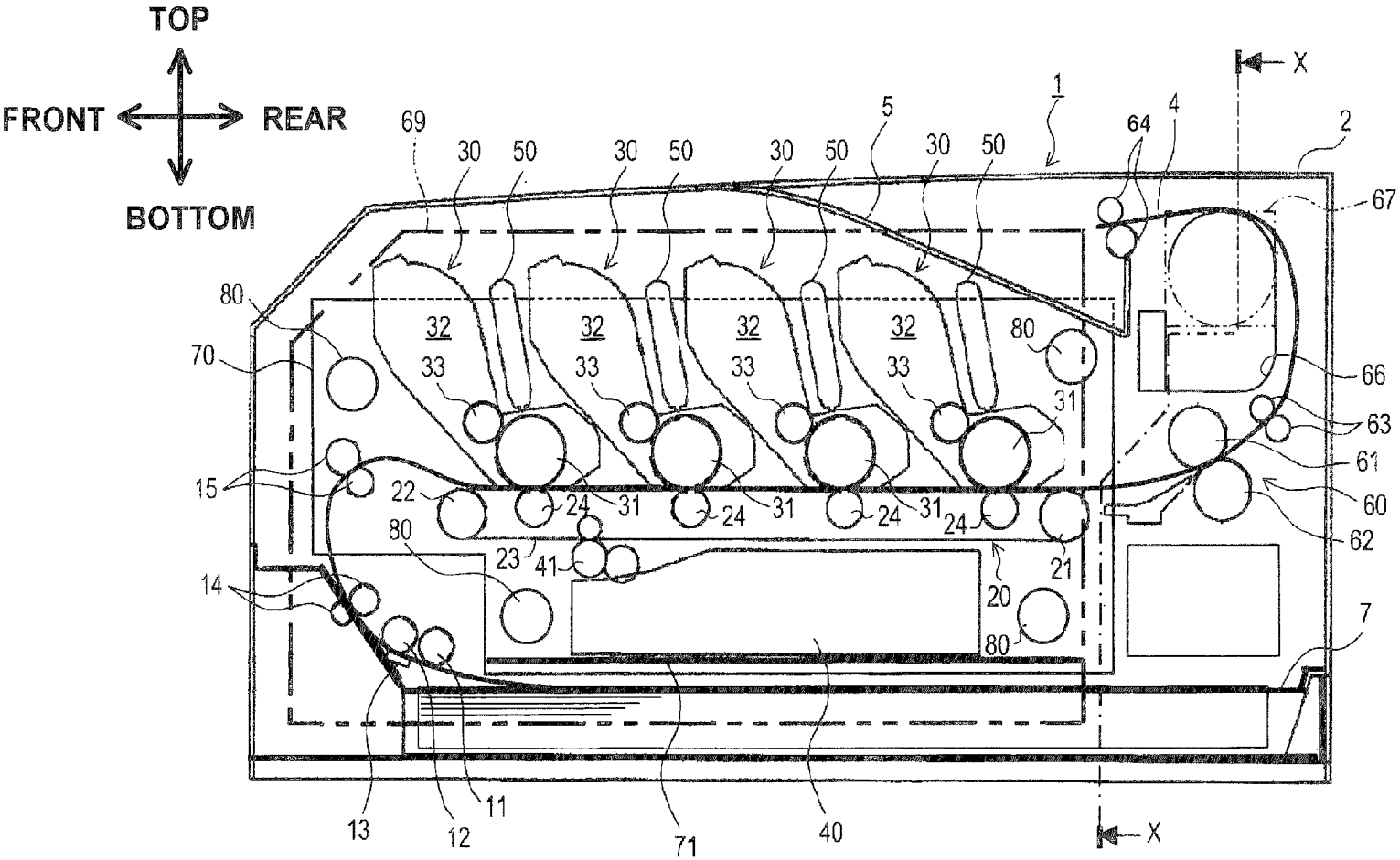
FIG. 1 is a side sectional view schematically illustrating an internal structure of an illustrative example of an image forming apparatus using features described herein.

An illustrative embodiment will be described in detail with reference to the accompanying drawings. An image forming apparatus according to aspects of the invention applies is shown in FIG. 1.

It is noted that various connections are set forth between elements in the following description. It is noted that these connections in general and, unless specified otherwise, may be direct or indirect and that this specification is not intended to be limiting in this respect.

For ease of discussion, in the following description, the top or upper side, the bottom or lower side, the left or left side, the right or right side, the front or front side, and the rear or rear side are used to define the various parts when an image forming apparatus 1 is disposed in an orientation in which it is intended to be used. In FIG. 1, the left side is referred to as the front or front side, the right side is referred to as the rear or the rear side, the up side is referred to as the top or upper side, and the down side is referred to as the bottom or lower side.

A general structure of the image forming apparatus 1 will be described.

As shown in FIG. 1, the image forming apparatus 1 is a color printer of direct transfer tandem type, and may include a generally box-shaped housing 2. A top surface of the housing 2 contains an output tray 5 on which a recording medium, e.g. a recording sheet 4 having an image thereon can be placed. It is appreciated that indirect configurations of the printer may also be used (in which the printer includes a transfer belt that conveys an image to a recording medium).

A sheet supply tray 7 may be disposed in a lower portion of the housing 2 and configured to load a stack of sheets 4 therein. The sheet supply tray 7 may be configured to be pulled out toward the front. The sheet supply tray 7 is provided with a sheet pressing plate (not shown) inclinable to raise the front end of the stack of sheets 4. A pickup roller 11 to pick up sheets 4 is disposed in a front upper portion of the sheet supply tray 7. A separation roller 12 and a separation pad 13 are disposed on a downstream side of the pickup roller 11 in a direction where a sheet 4 is conveyed (hereinafter referred to as a sheet conveying direction). The separation roller 12 and the separation pad 13 are configured to separate the sheets 4 picked up by the pickup roller 11 one by one.

The uppermost recording sheet 4 in the sheet supply tray 7 is pressed against the pickup roller 11, fed and caught between the sheet supply roller 12 and the separation pad 13, and singly separated from a stack of recording sheets 4. The recording sheet 4 is then fed by a pair of feed rollers 14 toward registration rollers 15. The registration rollers 15 feed the recording sheet 4 at a predetermined timing onto a belt unit 20.

The belt unit 20 is configured to be attached to and removed from the housing 2 and includes a drive roller 21, a tension roller 22, and a conveyor belt 23. The drive roller 21 and the tension roller 22 are spaced apart in the front-rear direction in parallel to each other at their rotation shafts. The tension roller 22 is urged toward the front by a spring (not shown) to apply an appropriate tension to the conveyor belt 23. Thus, the conveyor belt 23 is horizontally extended between and looped around the drive roller 21 and the tension roller 22. The conveyor belt 23 is an endless semiconducting belt (transfer belt) made of a resin such as polycarbonate. When the drive roller 21 disposed at the rear is driven and rotated by a main motor (not shown), the conveyor belt 23 rotates counterclockwise in FIG. 1 to convey the sheet 4 thereon rearward.

Inside the conveyor belt 23, four transfer rollers 24 are spaced apart at regular intervals in the front-rear direction. The transfer rollers 24 are disposed facing respective photosensitive drums 31 of process units, e.g., image formation units 30 via the conveyor belt 23. In other words, the conveyor belt 23 is sandwiched between the transfer rollers 24 and the corresponding photosensitive drums 31. During image transfer, a bias is applied between the transfer rollers 24 and the corresponding photosensitive drums 31, and a specified amount of current is passed therebetween.

A belt cleaner unit 40 is disposed below the belt unit 20. The belt cleaner unit 40 includes a cleaning roller 41 and is configured to remove waste, such as toner and dust adhering to the conveyor belt 23.

The image forming apparatus 1 includes four image formation units 30 paired with LED units 50. The image formation units 30 are disposed at front of the corresponding LED units 50. The image formation units 30 are provided for four colors of black, cyan, magenta, and yellow and arranged in this color order from an upstream side with respect to the sheet conveying direction or from the front side of the image forming apparatus 1. The image formation units 30 and the LED units 50 are arranged in line along the sheet conveying direction. The image formation units 30, the LED units 50, and the belt unit 20 function as an image formation device.

Each image formation unit 30 is of known construction and includes an electrostatic latent image carrier, e.g. the photosensitive drum 31, a toner chamber 32, and a developing roller 33. The toner chamber 32 accommodates a developer, e.g. one-component toner, which is to be positively charged, of black, cyan, magenta, or yellow. The developing roller 33 is disposed opposite to the photosensitive drum 31 and configured to positively charge toner and supply it to the photosensitive drum 31. In the image formation unit 30, upon rotation of the photosensitive drum 31, the surface of the photosensitive drum 31 is uniformly and positively charged by a scorotron charger (not shown), and exposed to light emitted from an array of light emitting diodes (LEDs, not shown) arranged in a line at a lower end of the LED unit 50 across the width of a sheet or in the left-right direction of the image forming apparatus 1, and an electrostatic latent image is formed, on the surface of the photosensitive drum 31, based on the image to be formed on the sheet 4.

When the developing roller 33 rotates, positively charged toner carried on the developing roller 33 is supplied to the electrostatic latent image formed on the surface of the photosensitive drum 31. Thus, the latent image on the photosensitive drum 31 becomes visible, and a toner image, in which toner is adhered to an exposed area only, is carried on the surface of the photosensitive drum 31.

While the sheet 4 is conveyed by the conveyor belt 23 and passes between each photosensitive drum 31 and its corresponding transfer roller 24, the toner image carried on the surface of each photosensitive drum 31 is successively transferred onto the sheet 4 by the current. The sheet 4 to which the toner image of each color has been transferred in this manner is conveyed to a fixing unit 60.

The fixing unit 60 is disposed at the rear of the conveyor belt 23 in the housing 2. The fixing unit 60 includes a heat roller 61 and a pressure roller 62. The heat roller 61 has a heat source such as a halogen lamp and is configured to be driven and rotated. The pressure roller 62 is disposed facing the heat roller 61 so as to press the heat roller 61 from below and configured to be rotated along with the rotation of the heat roller 61. In the fixing unit 60, the sheet 4 having the toner image of each color thereon is heated while it is conveyed between the heat roller 61 and the pressure roller 62, and the toner image of each color is thermally fixed onto the sheet 4. The sheet 4 on which the toner image of each color has been thermally fixed is conveyed between ejection rollers 63, which are disposed diagonally above the fixing unit 60. The sheet 4 is further conveyed between ejection rollers 64 disposed in the upper portion of the housing 2, and is finally ejected to the output tray 5.

A fan 67 is disposed above the fixing unit 60. The fan 67 and a circuit board 69 are disposed on the right side of the image forming apparatus 1. The fan 67 is configured to circulate air, e.g. suck air through a duct 66 that is disposed above the fixing unit 60 and behind the image formation units 30. The circuit bard 69 is configured to supply power to the individual parts. A pair of engine frames 70 is disposed on the right and left sides of the belt unit 20, the image formation units 30, the belt cleaner unit 40, and the LED units 50 to support them.

Figure 2:
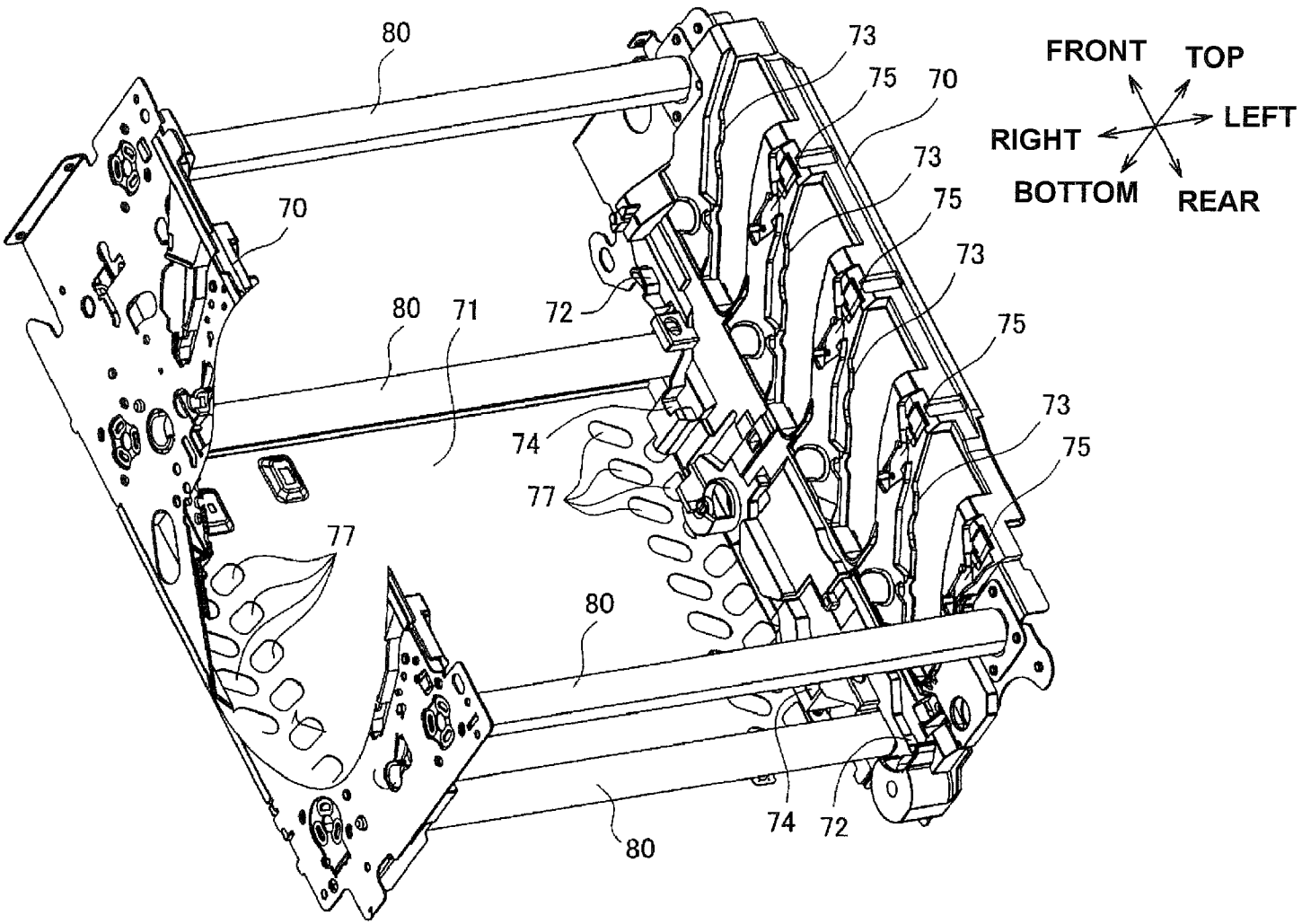
FIG. 2 is a perspective view of an engine frame of the image forming apparatus.

The engine frames 70 that support the above units will be described with reference to FIG. 2. FIG. 2 is a perspective, partially cutaway view of the engine frames 70. As shown in FIG. 2, the engine frames 70 are formed of sheet metal by stamping to have left-right symmetry, and disposed inside the housing 2. The engine frames 70 are connected by tubular reinforcing members 80 disposed horizontally at four places of a front upper portion, a front lower portion, a rear upper portion, and a rear lower portion. A flat partition plate 71 is fixed at the lower ends of the engine frames 70 and configured to horizontally partition between the belt cleaner unit 40 and the sheet supply tray 7.

Each engine frame 70 is provided with a belt unit mounting portion 72 in which the belt unit 20 is mounted via a resin member (not shown), four image forming unit mounting portions 73 in which the image formation units 30 are mounted, a belt cleaner mounting portion 74 in which the belt cleaner unit 40 is mounted via a resin member (not shown), and four LED unit mounting portion 75 to which the LED units 50 are mounted. The partition plate 71 is formed with a number of holes 77. The holes 77 are disposed in two rows along and on each side of the partition plate 71 with respect to the sheet conveying direction.

Figure 3:
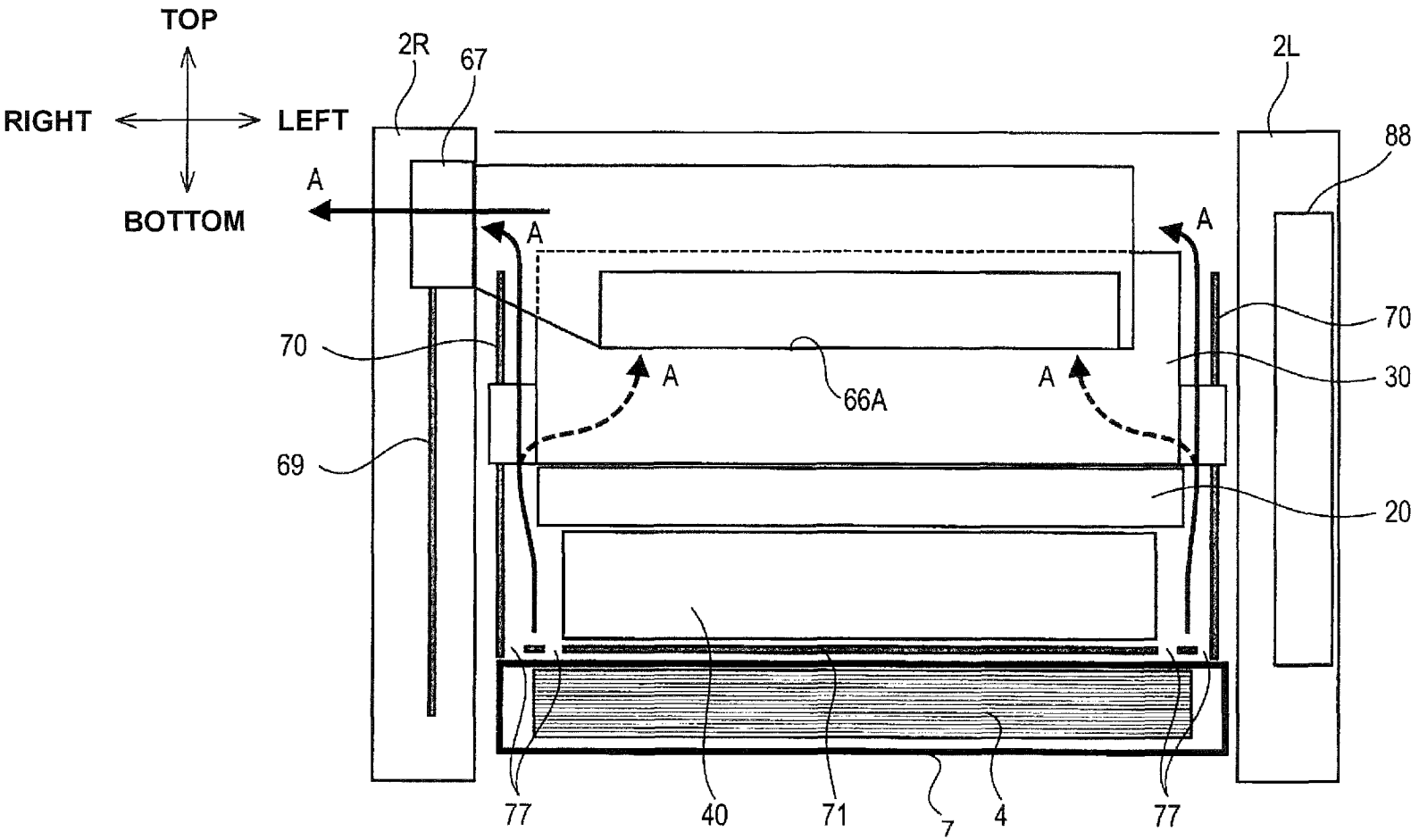
FIG. 3 is a cross sectional view taken along the line X-X of FIG. 1.

FIG. 3 is a cross sectional view taken along the line X-X of FIG. 1 in which the LED units 50 are not shown. As shown in FIG. 3, the engine frames 70 are supported between a pair of resin frames 2L, 2R that make up a part of the housing 2, such that the partition plate 71 is disposed a predetermine distance apart above the sheet supply tray 7. The resin frames 2L, 2R are made of a synthetic resin and shaped in hollow rectangular solids. The right resin frame 2R accommodates the fan 67 and the circuit board 69, and the left resin frame 2L accommodates a drive system 88 configured to drive each unit. The belt cleaner unit 40, the belt unit 20, the four image formation units 30, and the four LED units 50 are disposed above the partition plate 71 in this order from the bottom between the pair of the engine frames 70.

As shown in FIGS. 1 and 3, the duct 66 is disposed behind the rearmost image formation unit 30 and an intake 66A of the duct 66 is oriented toward an upper portion of the image formation unit 30. When the fan 67 is driven, a current of air is produced as shown by arrows A (broken and unbroken) of FIG. 3. That is, air passes through the holes 77 of the partition plate 71 from a space above the sheet supply tray 7, and clearances between the left and right sides of the belt cleaner unit 40 and the belt unit 20 and the corresponding engine frames 70. Then, air diffuses around each image formation unit 30, passes around each LED unit 50, moves upward through the intake 66A, and is discharged outside from the fan 67. This passage of air allows each image formation unit 30 and neighboring components to be cooled favorably.

In this embodiment, air is taken through the holes 77 that are formed on the partition plate 71 from the space above the sheet supply tray 7 which is freely ventilated with outside. This eliminates the need for a duct or intake for feeding air downward. Thus, the image forming apparatus 1 of the embodiment can provide an increased flexibility in designing, and a simple structure, which can reduce manufacturing costs. As shown in the embodiment, when the left and right resin frames 2L, 2R are provided with the drive system 88 and the circuit board 69 respectively, a space for providing an intake may be reduced, however, there is no need to dispose such an intake. In addition, when air passes between the driving system 88 and the image formation units 30, air warmed by a motor (not shown) disposed in the driving system 88 can be favorably discharged.

This illustrative embodiment shows, but is not limited to, that electrostatic latent images are formed on the photosensitive drums 31 by LEDs. The electrostatic latent images may be formed on the photosensitive drums 31 by laser light.

This illustrative embodiment shows, but is not limited to, that air inside is discharged from the right side of the image forming apparatus 1 by the fan 67. Air inside may be discharged from the rear side, top side, front side, left side, bottom side and any combinations of sides of the image forming apparatus 1.

It will be appreciated that this embodiment also applies to other types of image forming apparatuses, such as a facsimile machine having an image reading device, e.g. a scanner, and a copier, as well.

While the features herein have been described in connection with various example structures and illustrative aspects, it will be understood by those skilled in the art that other variations and modifications of the structures and aspects described above may be made without departing from the scope of the inventions described herein. Other structures and aspects will be apparent to those skilled in the art from a consideration of the specification or practice of the features disclosed herein. It is intended that the specification and the described examples only are illustrative with the true scope of the inventions being defined by the following claims.

What is claimed is:

1. An image forming apparatus comprising:

a pair of opposing side frames;

a plurality of image formation units disposed between the side frames, each of the image formation units including an image carrier configured to rotate about a corresponding one of a plurality of rotational axes and to form an image carried on the image carrier onto a recording medium, the side frames being perpendicular to the rotational axes;

a plate disposed below the image formation units, the plate connecting the side frames, the plate having a plurality of holes arranged along and adjacent to each of the side frames; and a fan disposed above the plate, wherein the image forming apparatus includes a passage extending from the holes in the plate to the fan, wherein the image formation units and each of the side frames define a portion of the passage, such that the passage is configured to direct air flowing from the holes to the fan through the portion of the passage formed by the image formation units and each of the side frames.

2. The image forming apparatus according to claim 1, further comprising an endless belt disposed opposite to the image formation units, the endless belt being configured to rotate and convey the recording medium, wherein each of the side frames and the endless belt define the portion of the passage.

3. The image forming apparatus according to claim 1, further comprising:

an endless belt disposed opposite to the image formation units, the endless belt being configured to rotate and convey the recording medium; and a belt cleaner configured to clean the endless belt, wherein each of the side frames and the belt cleaner define the portion of the passage.

4. The image forming apparatus according to claim 1, further comprising a sheet supply unit configured to hold recording media in stack, the sheet supply unit being disposed below the plate.

5. The image forming apparatus according to claim 1, wherein the holes are disposed in a plurality of rows along and adjacent to each of the side frames.

6. The image forming apparatus according to claim 1, further comprising a fixing unit configured to fix the image onto the recording medium, wherein the fan is disposed above the fixing unit.

7. The image forming apparatus according to claim 1, further comprising a housing configured to accommodate the image formation units and the plate and mount a sheet supply unit detachably, wherein the housing includes the side frames and at least one of the side frames includes a circuit board inside.

8. The image forming apparatus according to claim 1, wherein the plate lacks holes in a central region of the plate.

9. The image formation apparatus according to claim 1, wherein multiple passages are formed by the pair of opposing side frames and the plurality of image formation units.

* * * * *